US010229623B2

(12) United States Patent
Ando

(10) Patent No.: US 10,229,623 B2
(45) Date of Patent: Mar. 12, 2019

(54) IMAGE DISPLAY APPARATUS AND CONVERSION INFORMATION GENERATION METHOD

(71) Applicant: CANON KABUSHIKI KAISHA, Tokyo (JP)

(72) Inventor: Muneki Ando, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 68 days.

(21) Appl. No.: 15/373,028

(22) Filed: Dec. 8, 2016

(65) Prior Publication Data

US 2017/0169751 A1 Jun. 15, 2017

(30) Foreign Application Priority Data

Dec. 15, 2015 (JP) ..... 2015-244209
Oct. 7, 2016 (JP) ..... 2016-198718

(51) Int. Cl.

*G09G 3/20* (2006.01)
*G09G 3/34* (2006.01)
*G09G 5/02* (2006.01)
*G09G 3/36* (2006.01)

(52) U.S. Cl.

CPC ..... *G09G 3/2003* (2013.01); *G09G 3/3413* (2013.01); *G09G 3/3648* (2013.01); *G09G 5/02* (2013.01); *G09G 3/3406* (2013.01); *G09G 2340/06* (2013.01); *G09G 2380/10* (2013.01)

(58) Field of Classification Search

CPC ..... G09G 3/2003; G09G 3/3413; G09G 2340/06; G09G 5/02; G09G 3/3648; G09G 3/3406; G09G 2380/10; G09G 2360/16

See application file for complete search history.

(56) References Cited

U.S. PATENT DOCUMENTS

| | | | | |
|---|---|---|---|---|
| 4,959,711 | A | 9/1990 | Hung et al. | 358/523 |
| 8,619,349 | B2 | 12/2013 | Kishino et al. | 358/518 |
| 2009/0122075 | A1* | 5/2009 | Park | G09G 3/2003 345/602 |
| 2010/0188434 | A1* | 7/2010 | An | G09G 3/342 345/690 |
| 2014/0286628 | A1 | 9/2014 | Ando et al. | H04N 9/793 |

(Continued)

FOREIGN PATENT DOCUMENTS

| | | |
|---|---|---|
| JP | S64-013890 | 1/1989 |
| JP | 2012-178738 | 9/2012 |

*Primary Examiner* — Saptarshi Mazumder
(74) *Attorney, Agent, or Firm* — Venable LLP

(57) ABSTRACT

An image display apparatus according to the present invention includes: a display panel configured to display an image; a light emitting unit configured to emit light onto the display panel; an acquisition unit configured to acquire an expansion parameter to expand a reproducible color gamut, which is a range of colors that the image display apparatus can reproduce, from a reference color gamut to an expanded color gamut; and a conversion unit configured to generate output image data by performing, on input image data, color conversion processing to convert a color outside the expanded color gamut into a color within the expanded color gamut based on the expansion parameter, wherein the light emitting unit increases an emission brightness of the light emitting unit based on the expansion parameter.

12 Claims, 12 Drawing Sheets

(56) References Cited

U.S. PATENT DOCUMENTS

2015/0346987 A1* 12/2015 Ren ..... G06F 1/32
345/589
2015/0348501 A1* 12/2015 Mitsui ..... G09G 5/02
345/690

* cited by examiner

FIG. 2

| L* VALUE | a* VALUE | b* VALUE | N |
|---|---|---|---|
| 0 | -120 | -120 | 0 |
| 0 | -120 | -115 | 0 |
| ⋮ | ⋮ | ⋮ | ⋮ |
| 0 | -120 | 120 | 0 |
| 0 | -115 | -120 | 0 |
| 0 | -115 | -115 | 0 |
| ⋮ | ⋮ | ⋮ | ⋮ |
| 0 | 0 | 0 | 1 |
| ⋮ | ⋮ | ⋮ | ⋮ |
| 0 | 120 | 120 | 0 |
| 1 | -120 | -120 | 0 |
| ⋮ | ⋮ | ⋮ | ⋮ |
| 50 | 30 | 50 | 1 |
| ⋮ | ⋮ | ⋮ | ⋮ |
| 70 | -50 | -50 | 1 |
| ⋮ | ⋮ | ⋮ | ⋮ |
| 100 | 0 | 0 | 1 |
| ⋮ | ⋮ | ⋮ | ⋮ |
| 100 | 120 | 120 | 0 |

FIG. 8

| INPUT COLOR GAMUT SET VALUE | EXPANSION PARAMETER |
|---|---|
| StdGamut | 1.0 |
| WideGamut-A | 1.3 |
| WideGamut-B | 1.4 |
| SuperWideGamut | 2.0 |

IMAGE DISPLAY APPARATUS AND CONVERSION INFORMATION GENERATION METHOD

BACKGROUND OF THE INVENTION

Field of the Invention

The present invention relates to an image display apparatus and a conversion information generation method.

Description of the Related Art

Various methods have been proposed for converting the color gamut of image data. For example, as a method for converting (mapping) a color outside the converted color gamut into a color within the converted color gamut, a method of compressing lightness and saturation while maintaining a hue has been proposed (Japanese Patent Application Laid-open No. 2012-178738). Further, a method of expanding an apparent saturation reproduction range, by performing mapping to drop the lightness so that white is converted into gray, has been proposed (Japanese Patent Application Laid-open No. S64(H1)-13890).

However, in the case of these conventional methods, the mapping performed drops the lightness or saturation of the image data either partly or entirely.

SUMMARY OF THE INVENTION

The present invention provides a technique to suppress the drop in the lightness and expand the color gamut of the display image.

The present invention in its first aspect provides an image display apparatus, comprising:

a display panel configured to display an image;

a light emitting unit configured to emit light onto the display panel;

an acquisition unit configured to acquire an expansion parameter to expand a reproducible color gamut, which is a range of colors that the image display apparatus can reproduce, from a reference color gamut to an expanded color gamut; and a conversion unit configured to generate output image data by performing, on input image data, color conversion processing to convert a color outside the expanded color gamut into a color within the expanded color gamut based on the expansion parameter, wherein the light emitting unit increases an emission brightness of the light emitting unit based on the expansion parameter.

The present invention in its second aspect provides an image display apparatus, comprising:

a display unit configured to display an image;

an acquisition unit configured to acquire an expansion parameter to expand a reproducible color gamut, which is a range of colors that the image display apparatus can reproduce, from a reference color gamut to an expanded color gamut; and a conversion unit configured to generate output image data by performing, on input image data, color conversion processing to convert a color outside the expanded color gamut into a color within the expanded color gamut based on the expansion parameter, wherein the display unit increases a display brightness of the display unit based on the expansion parameter.

The present invention in its third aspect provides a conversion information generation method, comprising:

an acquisition step of acquiring an expansion parameter to expand a reproducible color gamut, which is a range of colors that an image display apparatus can reproduce, from a reference color gamut to an expanded color gamut by increasing a display brightness of the image display apparatus; and a conversion step of generating, by performing color conversion processing to convert a color outside the expanded color gamut into a color within the expanded color gamut, on a plurality of possible pixel values of the input image data, based on the expansion parameter, information indicating correspondence between pixel values of the input image data and pixel values after the color conversion processing is performed, as conversion information.

The present invention in its fourth aspect provides a non-transitory computer readable medium that stores a program, wherein the program causes a computer to execute:

an acquisition step of acquiring an expansion parameter to expand a reproducible color gamut, which is a range of colors that an image display apparatus can reproduce, from a reference color gamut to an expanded color gamut by increasing a display brightness of the image display apparatus; and a conversion step of generating, by performing color conversion processing to convert a color outside the expanded color gamut into a color within the expanded color gamut, on a plurality of possible pixel values of the input image data, based on the expansion parameter, information indicating correspondence between pixel values of the input image data and pixel values after the color conversion processing is performed, as conversion information.

According to the present invention, the drop in the lightness can be suppressed, and the color gamut of the display image can be expanded.

Further features of the present invention will become apparent from the following description of exemplary embodiments with reference to the attached drawings.

BRIEF DESCRIPTION OF THE DRAWINGS

FIG. 2 shows an example of expanded color gamut information according to Example 1;

FIG. 8 shows an example of an expanded parameter table according to Example 2;

DESCRIPTION OF THE EMBODIMENTS

Example 1

Example 1 of the present invention will now be described. Here, a case where an image display apparatus includes an image generation apparatus according to this example will be described, but the image generation apparatus may be an independent apparatus separated from the image display apparatus.

Figure 1:
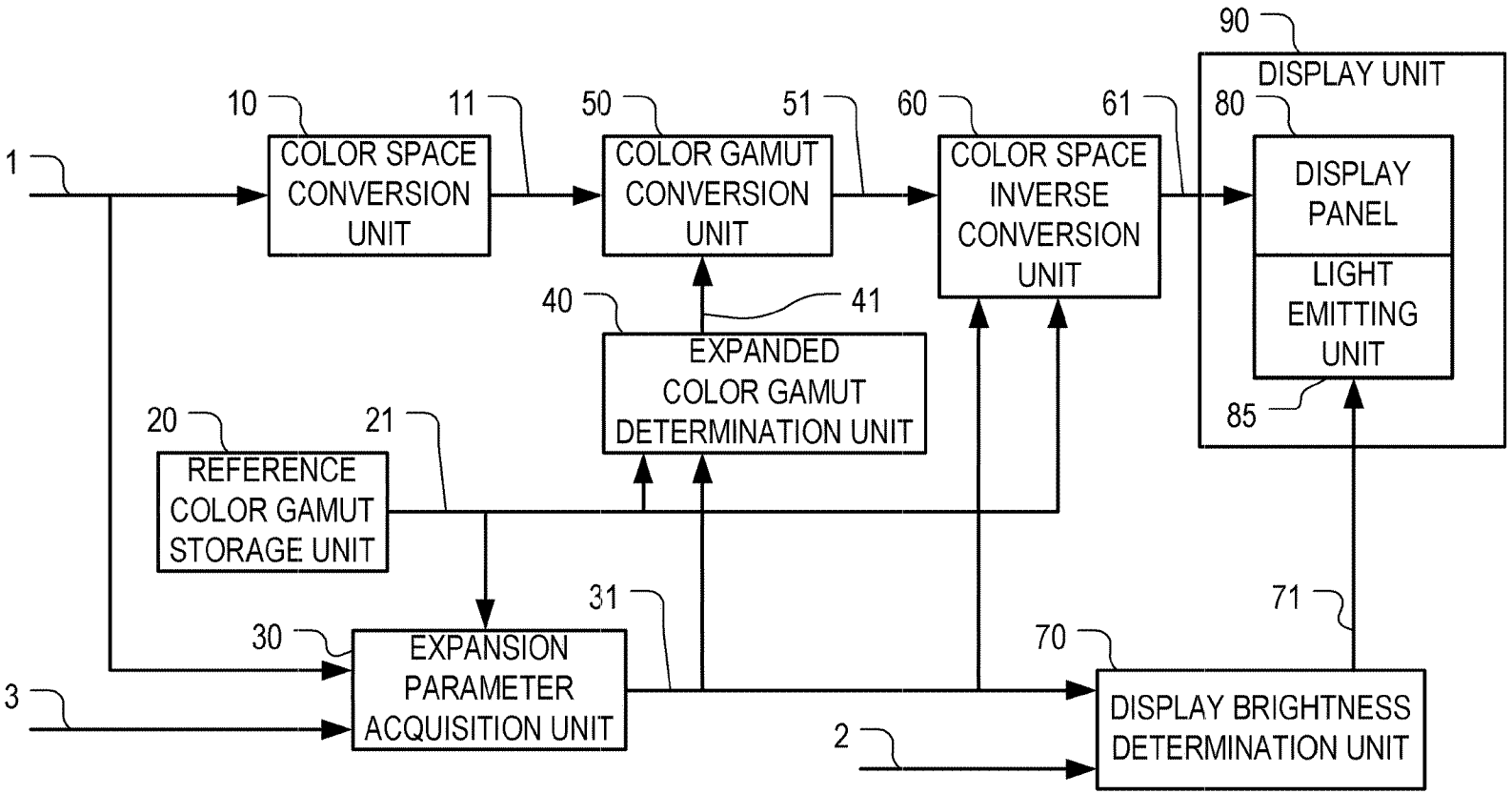
FIG. 1 is a block diagram depicting a configuration example of an image display apparatus according to Example 1.

FIG. 1 is a block diagram depicting a configuration example of an image display apparatus according to this example. Input image data 1, a brightness set value 2 and an input color gamut set value 3 are input to the image display apparatus according to this example. In this example, as the input image data 1, color image data, in which each pixel value has RGB values (a combination of an R value corresponding to red, a G value corresponding to green, and a B value corresponding to blue), is input. The brightness set value 2 is a value that is set as a reference value of the display brightness (brightness of the screen) of the image display apparatus. In this example, a reference value of the brightness of white is input as the brightness set value 2. Hereafter, white, of which brightness value is the reference value, is referred to as "100% white". The input color gamut set value 3 is a set value on the color gamut in the input image data 1 (color gamut that is assumed in the input image data 1). In concrete terms, as the input color gamut set value 3, red XYZ tristimulus values (X value, Y value, Z value)=(iRX, iRY, iRZ), green XYZ tristimulus values (iGX, iGY, iGZ), blue XYZ tristimulus values (iBX, iBY, iBZ) and white XYZ tristimulus values (iWZ, iWY, iWZ) are input. In these XYZ tristimulus values, the X value, the Y value and the Z value are normalized so that the Y value becomes 1.

The input color gamut set value 3 may or may not be additional data (meta data) added to the input image data 1. If the input color gamut set value 3 is added to the input image data 1, the input color gamut set value 3 can be acquired from the input image data 1. If the input color gamut set value 3 is not added to the input image data 1, the input image data 1 and the input color gamut set value 3 are input separately.

A color space conversion unit 10 generates uniform color space image data 11 by converting each pixel value of the input image data 1 from the RGB values into values of the CIE L*a*b*, which is a uniform color space (L*a*b* values). To convert RGB values into L*a*b* values, a calculation formula based on the definition of a CIE L*a*b* (CIELAB), or on an LUT which is a table created based on this calculation formula, is used. Hereafter, L*a*b* values (L* value, a* value, b* value), which are a pixel value of the uniform color space image data, are referred to as "L*a*b* values (iL, iA, iB)".

A reproducible color gamut, which is a range of colors that the image display apparatus can reproduce, depends on the display brightness. In concrete terms, the reproducible color gamut depends on the emission brightness of the light emitting unit 85, which will be described later. A reference color gamut storage unit 20 stores, in advance, information on a reference color gamut (reference color gamut information) 21, which is a reproducible color gamut in the case where the light emitting unit 85 emits light at a predetermined reference emission brightness. In concrete terms, as the reference color gamut information 21, red XYZ tristimulus values (oRX, oRY, oRZ), green XYZ tristimulus values (oGX, oGY, oGZ), blue XYZ values (oBX, oBY, oBZ), and white XYZ tristimulus values (oWX, oWY, oWZ) are stored. In these XYZ tristimulus values, the X value, the Y value and the Z value are normalized so that the Y value becomes 1.

An expansion parameter acquisition unit 30 acquires an expansion parameter 31. The expansion parameter 31 is a parameter to expand the reproducible color gamut from the reference color gamut to the expanded color gamut by increasing the display brightness of the image display apparatus. In concrete terms, the expansion parameter 31 is a parameter to increase the emission brightness of the light emitting unit 85 from the reference brightness. In this example, the expansion parameter acquisition unit 30 calculates the expansion parameter 31 based on the input image data 1, the input color gamut set value 3, and the reference color gamut information 21. A predetermined value may be used for the input color gamut set value 3. The reference color gamut information 21 is predetermined information. Therefore, if the input color gamut set value 3 is a predetermined value, an algorithm, in which the input color gamut set value 3 and the reference color gamut information 21 are incorporated, can be provided in advance as the algorithm of the processing to calculate the expansion parameter 31. If such an algorithm is used, the "processing to calculate the expansion parameter 31 based on the input image data 1, the input color gamut set value 3 and the reference color gamut information 21" can be regarded as the "processing to calculate the expansion parameter 31 based only on the input image data 1".

An expanded color gamut determination unit 40 determines an expanded color gamut based on the reference color gamut information 21 and the expansion parameter 31, and generates information on the expanded color gamut (expanded color gamut information) 41. The reference color gamut information 21 is predetermined information, hence an algorithm, in which the reference color gamut information 21 is incorporated, can be provided in advance as an algorithm for processing to determine the expanded color gamut. If such an algorithm is used, the "processing to determine the expanded color gamut based on the reference color gamut information 21 and the expansion parameter 31" can be regarded as the "processing to determine the expanded color gamut based only on the expansion parameter 31".

A color gamut conversion unit 50 generates color gamut-converted image data 51 by performing the color conversion processing, to convert a color outside the expanded color gamut into a color within the expanded color gamut, on the uniform color space image data 11 corresponding to the input image data 1 based on the expansion parameter 31. In this example, the color conversion processing is performed based on the expanded color gamut information 41. The above mentioned color conversion processing can be implemented by selecting computation based on the expansion parameter 31. For this purpose, the image display apparatus includes the expanded color gamut determination unit 40.

A color space inverse conversion unit 60 generates display image data (output image data) 61 by converting each pixel value of the color gamut-converted image data 51 from the values in the uniform color space into the RGB values based on the reference color gamut information 21. In this example, in a case where the display image data 61 is generated, the color space inverse conversion unit 60 further performs, based on the expansion parameter 31, the brightness conversion processing to reduce an increase in the display brightness due to the expansion parameter 31. The reference color gamut information 21 is predetermined information, hence an algorithm in which the reference color gamut information 21 is incorporated can be provided in advance as an algorithm for converting each pixel value of the color gamut-converted image data 51. If such an algorithm is used, the phrase "based on the reference color gamut information 21" can be omitted in the description on the processing to convert each pixel value of the color gamut-converted image data 51. If an increase in the display brightness due to the expansion parameter 31 is allowed, the brightness conversion processing may be omitted.

A display brightness determination unit 70 determines a maximum value of the possible display brightness values (maximum display brightness) as a display brightness value 71 based on the expansion parameter 31 and the brightness set value 2. In this example, the display brightness determination unit 70 calculates the display brightness value 71 using the following Expression 1. In Expression 1, "Lset" is the brightness set value 2, "gg" is the expansion parameter 31, and "Ldrv" is the display brightness value 71. A predetermined value may be used as the brightness set value 2. If the brightness set value 2 is a predetermined value, an algorithm, in which the brightness set value 2 is incorporated, may be provided in advance as the algorithm of processing to determine the display brightness value 71. If such an algorithm is used, the "processing to determine the display brightness value 71 based on the expansion parameter 31 and the brightness set value 2" can be regarded as the "processing to determine the display brightness value 71 based only on the expansion parameter 31".

$$Ldrv = Lset \times gg \quad \text{(Expression 1)}$$

A display unit 90 displays an image on the screen based on the expansion parameter 31 (the display brightness value 71 determined based on the expansion parameter 31) and the display image data 61. In concrete terms, the display unit 90 displays an image on the screen such that the image is displayed at the maximum display brightness related to the display brightness value 71, in a case where the pixel value of the display image data 61 is the upper limit value. The display unit 90 includes a display panel 80 and a light emitting unit 85.

The display panel 80 is a modulation panel configured to form a pattern at a modulation rate in accordance with each pixel value of the display image data 61. In this example, the display panel 80 is a liquid crystal panel configured to form a pattern with transmittance in accordance with each pixel value of the display image data 61. An image corresponding to the display image data 61 is displayed on the screen by the light from the light emitting unit 85 transmitting through the display panel 80 with transmittance in accordance with the display image data 61.

The light emitting unit 85 emits light at the emission brightness in accordance with the display brightness value 71, and radiates the light onto the display panel 80. In this example, the light emitting unit 85 emits light at the emission brightness such that the maximum display brightness, related to the display brightness value 71, is acquired as the display brightness in a case where the transmittance of the display panel 80 is controlled to the upper limit value. The light emitting unit 85 radiates light onto the rear face of the display panel 80. Therefore the light emitting unit 85 can be regarded as a "backlight unit". The light emitting unit 85 is constructed by, for example, disposing a plurality of white light sources (light sources that emit white light) on a light source substrate. The light emitting unit 85 may also be constructed by disposing a plurality of red light sources (light sources that emit red light), green light sources (light sources that emit green light), and blue light sources (light sources that emit blue light) on the light source substrate respectively. Further, a configuration combining a quantum dot sheet, which excites green light and red light from a blue light using a light emitting unit 85, constituted by a plurality of blue light sources on the substrate, and the light emitting unit 85, may be used. For the various light sources, light emitting diodes LEDs (LEDs), for example, may be used.

A concrete example of the processing of the expansion parameter acquisition unit 30 will be described next. First, the expansion parameter acquisition unit 30 converts each of the RGB values (R value, G value, B value)=(iR, iG, iB) of the input image data 1 into the XYZ tristimulus values (iX, iY, iZ) based on the input color gamut set value 3. The XYZ tristimulus values (iX, iY, iZ) are XYZ tristimulus values corresponding to the RGB values (iLR, iLG, iLB) in the correspondence based on the input color gamut (correspondence between the RGB values having a linear gradation characteristic and the XYZ tristimulus values). In concrete terms, the expansion parameter acquisition unit 30 converts each of the RGB values (iR, iG, iB) of the input image data 1 into the RGB values (iLR, iLG, iLB) having a linear gradation characteristic (gamma characteristic of which gamma value γ is 1.0). The gradation values (R value, G value, B value) having the linear gradation characteristic are, for example, values normalized to 0 to 1. Then the expansion parameter acquisition unit 30 converts each of the RGB values (iLR, iLG, iLB) into the XYZ tristimulus values (iX, iY, iZ) based on the input color gamut set value 3.

The gradation characteristic of the RGB values (iR, iG, iB) is not especially limited, but in this example, it is assumed that the gradation characteristic of the RGB values (iR, iG, iB) is the gamma characteristic of which gamma value γ is 2.2. A number of bits of the R value iR, the G value iG or the B value iB is not especially limited, but in this example, it is assumed that the R value iR, G value iG and the B value iB are 8-bit values (0 to 255) respectively. The possible range of the R value iLR, the G value iLG or the B value iLB is not especially limited, but in this example, it is assumed that the R value iLR, the G value iLG and the B value iLB are values normalized to 0 to 1 respectively. Therefore, the RGB values (iLR, iLG, iLB) can be calculated using the following Expressions 1-1 to 1-3. The XYZ tristimulus values (iX, iY, iZ) can be calculated using the following Expression 2.

[Math. 1]

$$iLR = \left(\frac{iR}{255}\right)^{22} \quad \text{(Expression 1-1)}$$

$$iLR = \left(\frac{iR}{255}\right)^{22} \quad \text{(Expression 1-2)}$$

$$iLB = \left(\frac{iB}{255}\right)^{22} \quad \text{(Expression 1-3)}$$

$$\begin{pmatrix} iX \\ iY \\ iZ \end{pmatrix} = \begin{pmatrix} iRX & iGX & iBX \\ iRY & iGY & iBY \\ iRZ & iGZ & iBZ \end{pmatrix} \begin{pmatrix} iLR \\ iLG \\ iLB \end{pmatrix} \quad \text{(Expression 1-4)}$$

Then the expansion parameter acquisition unit 30 converts the XYZ tristimulus values (iX, iY, iZ) into the RGB values (otLR, otLG, otLB) having a linear gradation characteristic respectively based on the reference color gamut information 21. The RGB values (otLR, otLG, otLB) are RGB values corresponding to the XYZ tristimulus values (iX, iY, iZ) in the correspondence based on the reference color gamut (correspondence between the RGB values having a linear gradation characteristic, and the XYZ tristimulus values). The RGB values (otLR, otLG, otLB) can be calculated using the following Expression 3. By this processing, the color gamut of the input image data 1 is converted into the reference color gamut.

[Math. 2]

$$\begin{pmatrix} otLR \\ otLG \\ otLB \end{pmatrix} = \begin{pmatrix} oRX & oGX & oBX \\ oRY & oGY & oBY \\ oRZ & oGZ & oBZ \end{pmatrix}^{-1} \begin{pmatrix} iX \\ iY \\ iZ \end{pmatrix} \quad \text{(Expression 3)}$$

Then for each pixel of the input image data 1, the expansion parameter acquisition unit 30 determines the maximum value of the R value otLR, the G value otLG and the B value otLB as the maximum pixel gradation value otLmax. In other words, the expansion parameter acquisition unit 30 performs the computation of the following Expression for each of the RGB values (otLR, otLG, otLB). In Expression 4, max ( ) is a function to indicate the maximum value of the argument (value inside ( )).

$$otL\max=\max(otLR,otLG,otLB) \quad \text{(Expression 4)}$$

Then the expansion parameter acquisition unit 30 determines the maximum value of each maximum pixel gradation value otLmax as the maximum gradation value otLmaxA, as shown in the following Expression 5.

$$otL\max A=\max(otL\max \text{ of each pixel}) \quad \text{(Expression 5)}$$

If the maximum gradation value otLmaxA is greater than 1, the expansion parameter acquisition unit 30 determines the maximum gradation value otLmaxA as the expansion parameter 31 (gg), as shown in the following Expression 6-1. If the maximum gradation value otLmaxA is 1 or less, the expansion parameter acquisition unit 30 determines 1 as the expansion parameter 31 (gg), as shown in the following Expression 6-2.

$$\text{If } otL\max A>1: gg=otL\max A \quad \text{(Expression 6-1)}$$

$$\text{If } otL\max A\leq 1: gg=1 \quad \text{(Expression 6-2)}$$

In this example, as described above, the color gamut of the input image data 1 is converted into the reference color gamut, and the expansion parameter 31 is acquired based on the input image data after the color gamut is converted into the reference color gamut. In concrete terms, the expansion parameter 31 is acquired in accordance with the maximum value of the gradation values of the input image data, of which the color gamut has been converted into the reference color gamut. This example describes a case of acquiring an expansion parameter in accordance with the maximum value of the gradation values, of one frame of input image data, but the present invention is not limited to this. For each of a plurality of sub-regions constituting the image region of one frame of input image data, an expansion parameter in accordance with the maximum value of the gradation values of image data in this sub-region (a part of the input image data) may be acquired. The "image region of one frame of input image data" can be regarded as a "region on the screen". In this case, the light emitting unit 85 has a plurality of light emitting regions corresponding to the plurality of sub-regions, and for each of the plurality of light emitting regions, the emission brightness of this light emitting region is controlled in accordance with the expansion parameter of the sub-region corresponding to this light emitting region.

The method of acquiring the expansion parameter is not limited to the above mentioned method. For example, at least two computations of the above mentioned computations may be performed by one computation. For the processing to acquire the expansion parameter, a processing to read an expansion parameter from a storage unit storing expansion parameters, which are predetermined values, may be performed. The correspondence between the input color gamut set value and the expansion parameter may be predetermined so that an expansion parameter corresponding to the input color gamut set value 3 is acquired as the expansion parameter 31 based on this correspondence.

The correspondence between the operation mode (image quality mode) of the image display apparatus and the expansion parameter may be predetermined, so that an expansion parameter corresponding to the current image quality mode may be acquired as the expansion parameter 31 based on this correspondence. For example, if the user selects the high image quality model (color gamut expansion mode 1), the expansion parameter: 1.2 is acquired, and if the user selects the high image quality mode 2 (color gamut expansion mode 2), the expansion parameter: 1.4 is acquired. If the user selects the normal image quality mode (color gamut non-expansion mode), the expansion parameter may not be acquired, or the expansion parameter: 1 may be acquired.

A concrete example of the processing of the expanded color gamut determination unit 40 will be described next. First, the expanded color gamut determination unit 40 selects each of the plurality of colors as the target color. In concrete terms, the expanded color gamut determination unit 40 sequentially selects each of the plurality of L*a*b* values (tL, tA, tB) as the L*a*b* values corresponding to the target color, while changing each of the L* value tL, the a* value tA and the b* value tB within the following ranges.

tL: 0, 2, 4, . . . 100 tA: −120, −115, −110, . . . 120 tB: −120, −115, −110, . . . 120

Then, as the pixel value corresponding to the target color, the expanded color gamut determination unit acquires a plurality of values corresponding to a plurality of color components. The plurality of color components are not especially limited, but an example of acquiring the R value, the G value and the B value as the plurality of values will be described here.

First, the expanded color gamut determination unit 40 converts the L*a*b* values (tL, tA, tB) of the target color into the XYZ tristimulus values (tX, tY, tZ) based on the reference color gamut information 21. The XYZ tristimulus values (tX, tY, tZ) are XYZ tristimulus values corresponding to the L*a*b* values (tL, tA, tB) in the correspondence based on the reference color gamut (correspondence between the L*a*b* values and the XYZ tristimulus values). The XYZ tristimulus values (tX, tY, tZ) can be calculated using the following Expression 7-1 to 7-3.

$$tY=((tL+16)/116)^3\times oWY \quad \text{(Expression 7-1)}$$

$$tX=((tL+16)/116+tA/500)^3\times oWX \quad \text{(Expression 7-2)}$$

$$tZ=((tL+16)/116-tB/200)^3\times oWZ \quad \text{(Expression 7-3)}$$

Then the expanded color gamut determination unit 40 converts the XYZ tristimulus values (tX, tY, tZ) into the RGB values (tLR, tLG, tLB) based on the reference color gamut information 21. The RGB values (tLR, tLG, tLB) are RGB values corresponding to the XYZ tristimulus values (tX, tY, tZ) in the correspondence based on the reference color gamut (correspondence between the RGB values having a linear gradation characteristic and the XYZ tristimulus values). The RGB values (tLR, tLG, tLB) can be calculated using the following Expression 8.

[Math. 3]

$$\begin{pmatrix} tLR \\ tLG \\ tLB \end{pmatrix} = \begin{pmatrix} oRX & oGX & oBX \\ oRY & oGY & oBY \\ oRZ & oGZ & oBZ \end{pmatrix}^{-1} \begin{pmatrix} tX \\ tY \\ tZ \end{pmatrix} \quad \text{(Expression 8)}$$

Then the expanded color gamut determination unit 40 determines whether the target color is a color within the expanded color gamut by comparing each of the R value tLR, the G value tLG and the B value tLB with the expansion parameter 31 (gg). In concrete terms, if at least one of the R value tLR, the G value tLG and the B value tLB is greater than the expansion parameter 31 (gg), the expanded color gamut determination unit 40 determines that the target color is a color outside the expanded color gamut, and sets a color gamut flag N=0, which corresponds to the target color. If the R value tLR, the G value tLG and the B value tLB all conform to the expansion parameter 31 (gg) or less, the expanded color gamut determination unit 40 determines that the target color is a color within the expanded color gamut, and sets the color gamut flag N=1, which corresponds to the target color.

By computing Expressions 7-1 to 7-3 and Expression 8 and comparing the RGB values (tLR, tLG, tLB) with the expansion parameter 31 in respect of a plurality of target colors, the expanded color gamut is determined, and the expanded color gamut information 41 is generated. In concrete terms, the range of the target colors, for which the color gamut flag N=1 is set, is determined as the expanded color gamut. Then, as shown in FIG. 2, a three-dimensional table, for referring to the color gamut flag N using the L*a*b* values (tL, tA, tB) as an index, is generated as the expanded color gamut information 41.

The expanded color gamut determination method is not limited to the above mentioned method. For example, at least two computations, out of the above mentioned computations, may be performed by one computation. The expanded color gamut information 41 is not limited to the above mentioned three-dimensional table. The expanded color gamut information 41 can be any information as long as the expanded color gamut can be acquired from the expanded color gamut information 41.

Figure 3:
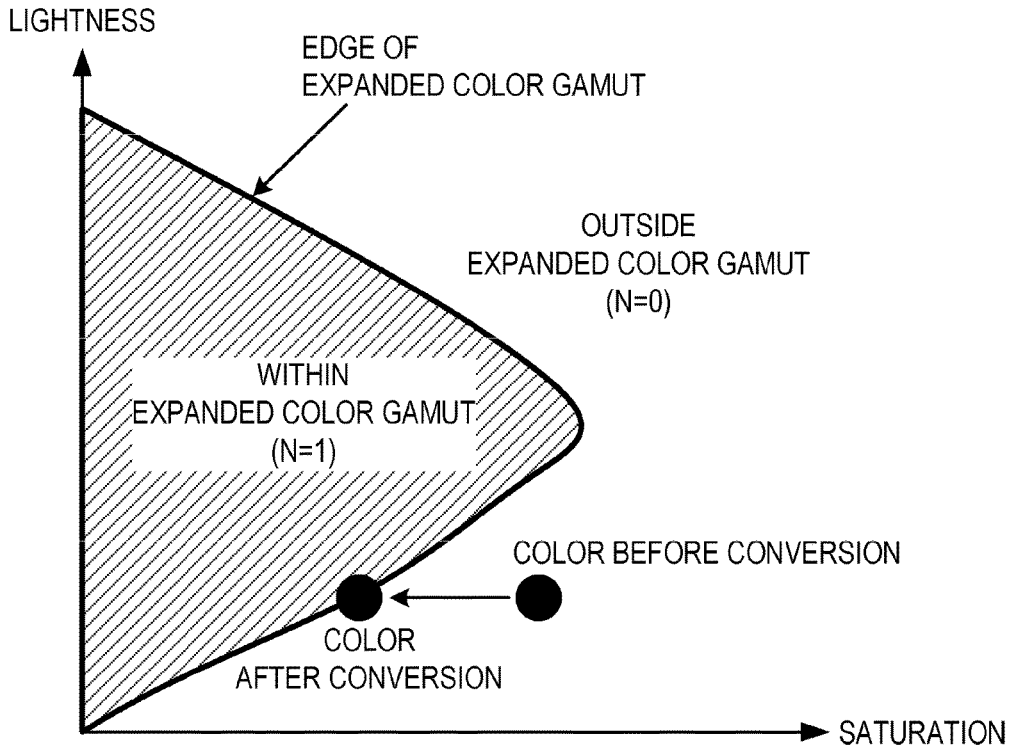
FIG. 3 is a diagram depicting an example of color conversion processing according to Example 1.
Figure 4:
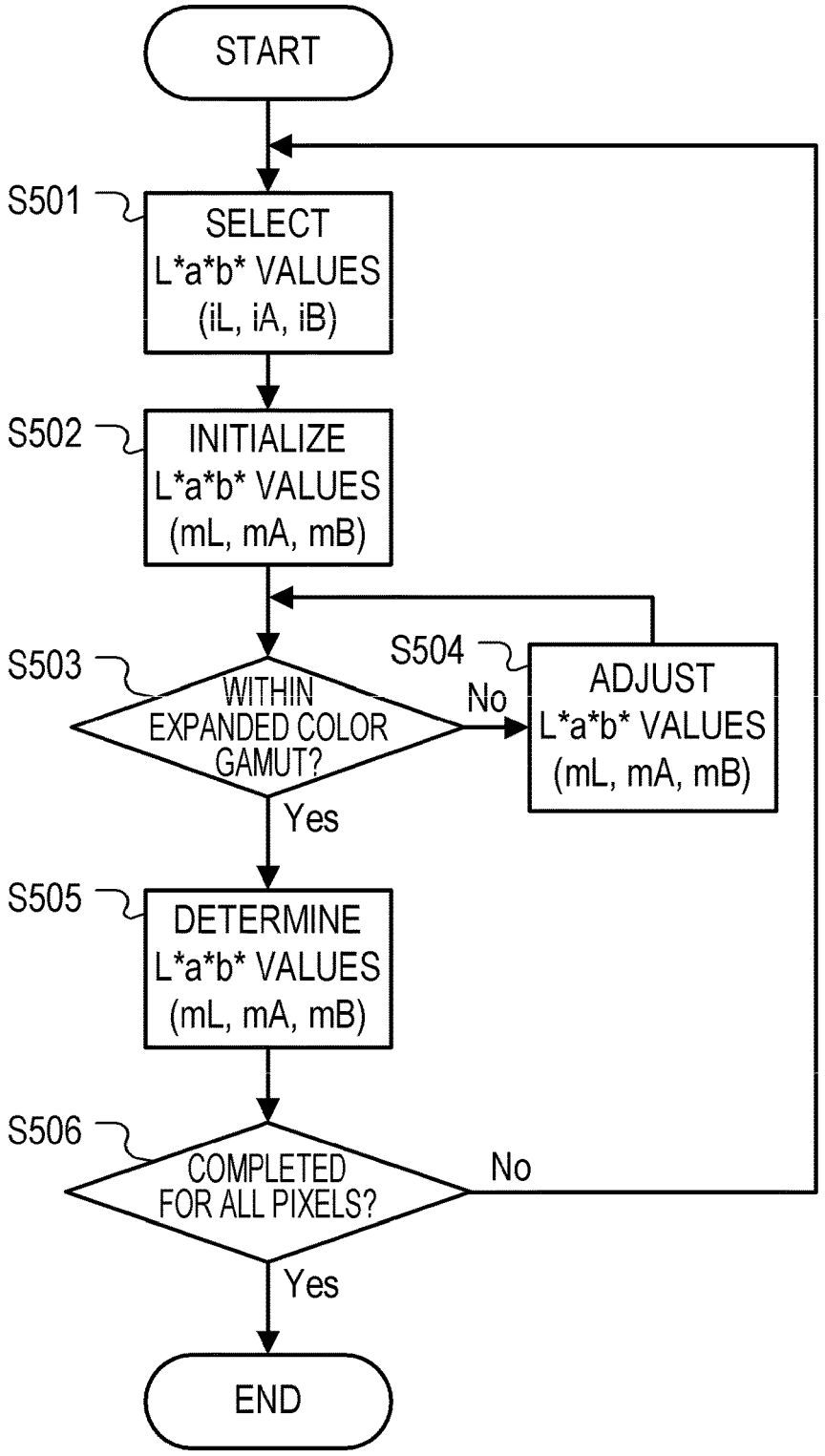
FIG. 4 is a flow chart depicting an example of the processing flow of a color gamut conversion unit according to Example 1.

A concrete example of the processing of the color gamut conversion unit 50 will be described next. In this example, as shown in FIG. 3, the color gamut conversion unit 50 converts the color by compressing saturation while maintaining the lightness in the uniform hue plane. FIG. 4 is a flow chart depicting an example of the processing flow of the color gamut conversion unit 50.

First, in S501, the color gamut conversion unit 50 selects the L*a*b* value (iL, iA, iB) of the uniform color space image data 11.

Then, in S502, the color gamut conversion unit 50 sets the L*a*b* values (iL, iA, iB) selected in S501 as the initial values of the L*a*b* values (mL, mA, mB), which are the pixel value of the color gamut-converted image data 51.

Then, in S503, the color gamut conversion unit 50 determines whether the color corresponding to the L*a*b* values (mL, mA, mB) is a color within the expanded color gamut based on the expanded color gamut information 41. In concrete terms, if the color gamut flag N, corresponding to the L*a*b* values (mL, mA, mB), is 1 in the expanded color gamut information 41, it is determined that the color corresponding to the L*a*b* values (mL, mA, mB) is a color within the expanded color gamut. If the color gamut flag N, corresponding to the L*a*b* values (mL, mA, mB), is 0 in the expanded color gamut information 41, it is determined that the color corresponding to the L*a*b* values (mL, mA, mB) is a color outside the expanded color gamut. If it is determined that the color corresponding to the L*a*b* values (mL, mA, mB) is a color within the expanded color gamut, processing advances to S505. If it is determined that the color corresponding to the L*a*B* values (mL, mA, mB) is a color outside the expanded color gamut, processing advances to S504.

In S504, the color gamut conversion unit 50 adjusts (corrects) the L*a*b* values (mL, mA, mB) so that saturation is compressed. In concrete terms, the adjusted L*a*b* values (mL, mA, mB) are calculated using the following Expressions 9-1 to 9-3. The values on the left side of Expressions 9-1 to 9-3 are the adjusted values.

$$mL = mL \quad \text{(Expression 9-1)}$$

$$MA = MA - iA \times 0.01 \quad \text{(Expression 9-2)}$$

$$mB = mB - iB \times 0.01 \quad \text{(Expression 9-3)}$$

After the processing in S504, processing returns to S503. Then the processing in S503 and 504 are repeated until it is determined that the color corresponding to the L*a*b* values (mL, mA, mB) is a color within the expanded color gamut. If it is determined that the color corresponding to the L*a*b* values (mL, mA, mB) is a color within the expanded color gamut, processing advances to S505. The adjusted valued of the a* value mA may be greater or lesser than 1% of the a* value iA. In the same manner, the adjusted value of the b* value mB may be greater or lesser than 1% of the b* value iB.

In S505, the color gamut conversion unit 50 determines the L*a*b* values (mL, mA, mB) as the pixel value of the color gamut-converted image data 51.

Then in S506, the color gamut conversion unit 50 determines whether the processing in S501 to S505 were executed for all the pixels of the uniform color space image data 11. If it is determined that there is a pixel for which the processing in S501 to S505 were not executed, processing returns to S501. Then the processing in S501 to S505 are repeatedly executed while sequentially selecting the uniform color space image data 11 as the processing target pixel. In a case where the processing in S501 to S505 are executed for all the pixels of the uniform color space image data 11, this processing flow ends. Then the color gamut conversion unit 50 outputs the color gamut-converted image data 51, which has the L*a*b* values (mL, mA, mB) determined in S505 as the pixel value.

A concrete example of the processing of the color space inverse conversion unit 60 will be described next. First, the color space inverse conversion unit 60 converts the L*a*b* values (mL, mA, mB), which are a pixel value, into the XYZ tristimulus values (mX, mY, mZ) for each pixel of the color gamut-converted image data 51. The XYZ tristimulus values (mX, mY, mZ) are the XYZ tristimulus values corresponding to the L*a*b* values (mL, mA, mB) in the correspondence based on the reference color gamut (correspondence between the L*a*b* values and the XYZ tristimulus values). The XYZ tristimulus values (mX, mY, mZ) can be calculated using the following Expressions 10-1 to 10-6.

$$mFY = (mL + 16)/116 \quad \text{(Expression 10-1)}$$

$$mFX=mFY+(mA/500) \quad \text{(Expression 10-2)}$$

$$mFZ=mFY+(mB/200) \quad \text{(Expression 10-3)}$$

$$mX=mFX^3\times oWX \quad \text{(Expression 10-4)}$$

$$mY=mFY^3\times oWY \quad \text{(Expression 10-5)}$$

$$mZ=mFZ^3\times oWZ \quad \text{(Expression 10-6)}$$

Then the color space inverse conversion unit 60 converts each of the XYZ tristimulus values (mX, mY, mZ) into the RGB values (mLR, mLG, mLB). The RGB values (mLR, mLG, mLB) are RGB values corresponding to the XYZ tristimulus values (mX, mY, mZ) in the correspondence based on the reference color gamut (correspondence between the RGB values having a linear gradation characteristic and the XYZ tristimulus values). The RGB values (mLR, mLG, mLB) can be calculated using the following Expression 11.

[Math. 4]

$$\begin{pmatrix} mLR \\ mLG \\ mLB \end{pmatrix} = \begin{pmatrix} oRX & oGX & oBX \\ oRY & oGY & oBY \\ oRZ & oGZ & oBZ \end{pmatrix}^{-1} \begin{pmatrix} mX \\ mY \\ mZ \end{pmatrix} \quad \text{(Expression 11)}$$

Then the color space inverse conversion unit 60 performs the above mentioned brightness conversion processing on each of the RGB values (mLR, mLG, mLB). In concrete terms, as shown in Expressions 12-1 to 12-3, the processing to divide each of the R value mLR, the G value mLG and the B value mLB by the expansion parameter 31 (gg) is performed as the brightness conversion processing. Thereby each of the RGB values (mLR, mLG, mLB) is converted into the RGB values (oLR, oLG, oLB).

$$oLR=mLR/gg \quad \text{(Expression 12-1)}$$

$$oLG=mLG/gg \quad \text{(Expression 12-2)}$$

$$oLB=mLB/gg \quad \text{(Expression 12-3)}$$

Then the color space inverse conversion unit 60 converts each of the RGB values (oLR, oLG, oLB) into the RGB values (oR, oG, oB) of the display image data 61. Thereby the display image data 61 is generated. Then the color space inverse conversion unit 60 outputs the display image data 61.

The graduation characteristic of the RGB values (oR, oG, oB) is not especially limited, but in this example, it is assumed that the gradation characteristic of the RGB values (oR, oG, oB) is a gamma characteristic of which gamma value $\gamma$ is 2.2. A number of bits of each of the R value oR, the G value oG and the B value oB is not especially limited, but in this example, it is assumed that the R value oR, the G value oG and the B value oB are 8-bit values (0 to 255). The possible range of the R value oLR, the G value oLG and the B value oLB is not especially limited, but in this example, the R value oLR, the G value oLG and the B value oLB are values normalized to 0~1. Therefore the RGB values (oR, oG, oB) can be calculated using the following Expressions 13-1 to 13-3.

$$oR=oLR^{1/2.2}\times 255 \quad \text{(Expression 13-1)}$$

$$oG=oLG^{1/2.2}\times 255 \quad \text{(Expression 13-2)}$$

$$oB=oLB^{1/2.2}\times 255 \quad \text{(Expression 13-3)}$$

A concrete example of the effect acquired in this example will be described next.

In this example, if the value of the expansion parameter 31 is 1, the display brightness of the image region of the display image data 61, of which pixel value is the upper limit value, matches with the brightness set value 2. The display brightness of the image region of the display image data 61, of which pixel value is the upper limit value, can be regarded as the "brightness of the screen region of the display panel 80 of which transmittance is the upper limit value". In this example, the brightness set value 2 is the brightness of 100% white. The state where the value of the expansion parameter 31 is 1 in the uniform color space can be regarded as a state where the lightness L of white is normalized to 100. And the reproducible color gamut in this state is the reference color gamut indicated by the broken line in FIG. 5.

Figure 5:
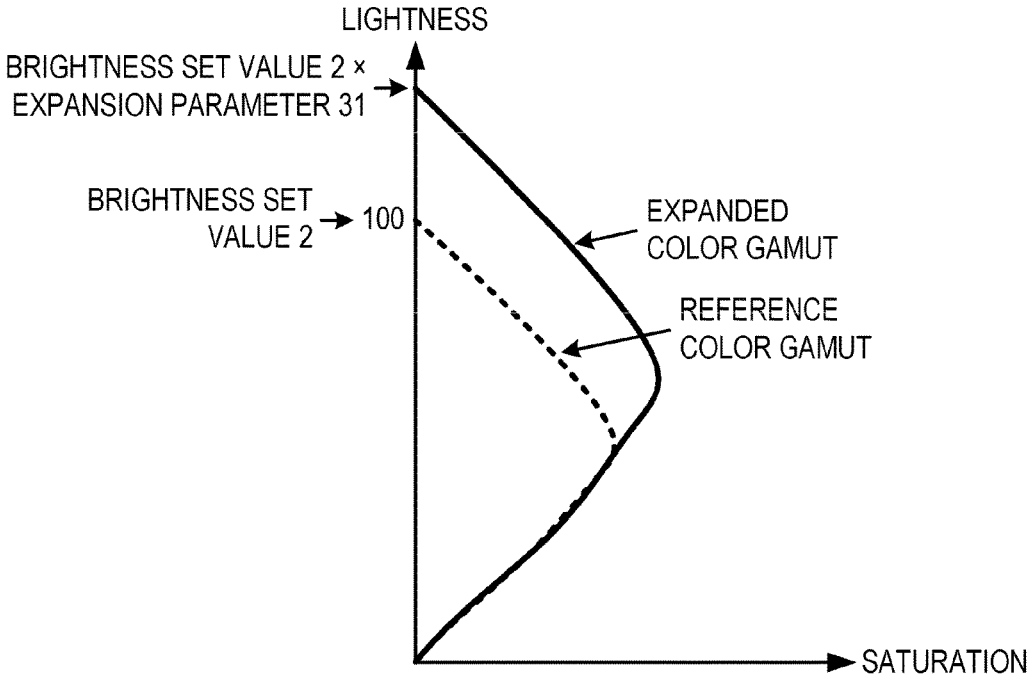
FIG. 5 is a diagram depicting an example of a reference color gamut and an expanded color gamut according to Example 1.

A case where the value of the expansion parameter 31 is greater than 1 will be described next. In the widely known conventional concept of a uniform color space, the lightness L of white is normalized to 100. Therefore the reproducible color gamut remains the same as the reference color gamut. In this example, on the other hand, the concept of the uniform color space is expanded, and the expanded color space, of which brightness of white is the brightness acquired by the brightness set value 2 and the expansion parameter 31, is defined. In this expanded color space, white, of which lightness L exceeds 100, can be expressed. As the lightness of white increases, the lightness of various colors (e.g. 3 primary colors: red, green, blue) also increase. Furthermore, according to the visual characteristic of human eyes, a color is perceived at higher saturation in a case where the given color is light compared with the case where the given color is dark. Hence, by using the expanded color space, an expanded color gamut, in which lightness is higher than the reference color gamut and saturation is expanded from the saturation of the reference color gamut, can be acquired. In FIG. 5, the color gamut indicated by the solid line is the expanded color gamut. The reference color gamut and the expanded color gamut in FIG. 5 are merely examples, and the reference color gamut and the expanded color gamut are not limited to the color gamut in FIG. 5.

Figure 6A:
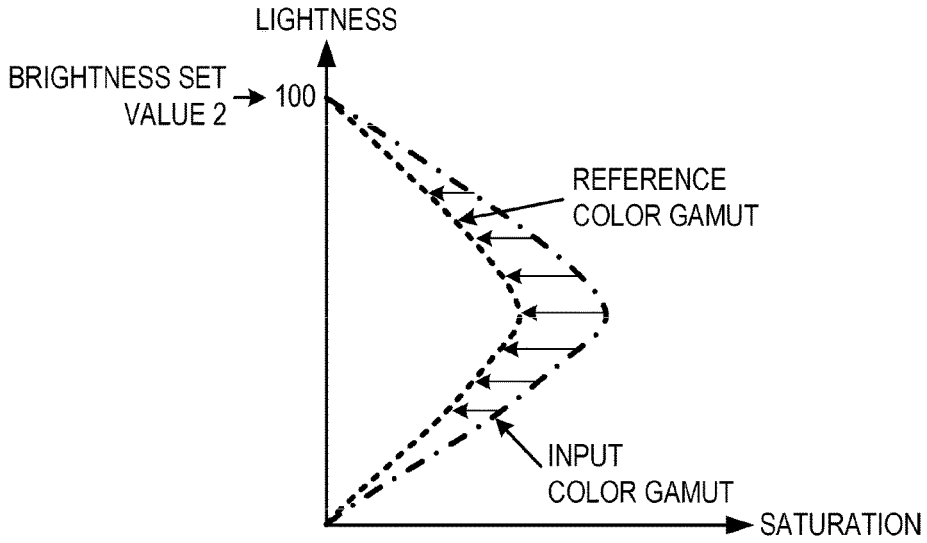
FIG. 6A and FIG. 6B are diagrams depicting an example of the effect according to Example 1.
Figure 6B:
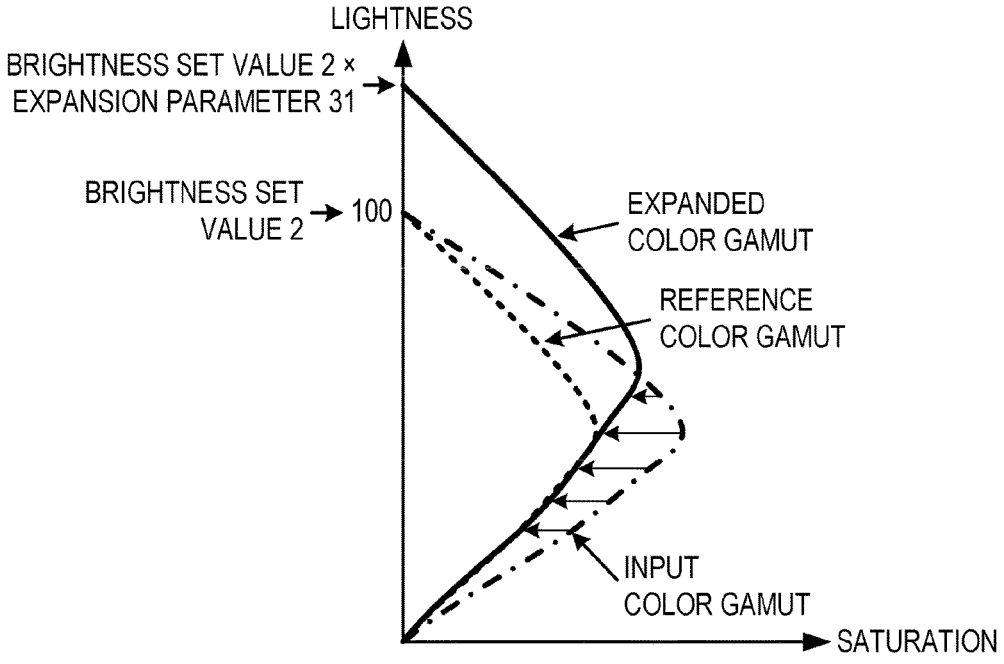

Here, a case where input image data, of which color gamut is wider than the reproducible color gamut, is input will be described. In the case of the conventional method, as shown in FIG. 6A, a color outside the reference color gamut is converted into a color within the reference color gamut (a color on the edge of the reference color gamut) by compressing the saturation while maintaining the lightness within a uniform hue plane. In this example, on the other hand, a color is converted not based on the reference color gamut, but on the expanded color gamut. In concrete terms, as shown in FIG. 6B, a color outside the expanded color gamut is converted into a color within the expanded color gamut (color on the edge of the expanded color gamut). Thereby, a drop in the display lightness (actual lightness on the screen) and the perceived lightness (lightness perceived by user) can be suppressed, and the color gamut of the display image can be expanded. In concrete terms, if the lightness of white of the input image data is the lightness of white of the expanded color gamut or less, the white can be displayed at a lightness exactly the same as the input image data. The other colors of the input image data (colors outside the reference color gamut) can also be displayed in the same manner, that is, if this color is within the expanded color gamut, this color can be displayed at a lightness exactly the same as the input image data. Further, the color gamut of the display image can be expanded in the direction of a higher lightness of the color (e.g. pastel color). According to the visual characteristic of human eyes, a color is perceived as darker in a case where the saturation of this color is low compared with the case where the saturation of this color is high. As shown in FIG. 6B, according to this example, the range of colors of which saturation is compressed can be reduced, hence a drop in perceived lightness can be suppressed.

As described above, according to this example, a drop in the display lightness and perceived lightness can be suppressed, and the color gamut of the display image can be expanded.

In this example, the case of using the L*a*b* color space is used as the color space for color conversion processing (mapping) was described, but a different color space may be used. For example, the L*u*v* color space may be used instead of the L*a*b* color space.

In this example, the case of performing the color conversion processing to compress the saturation while maintaining the lightness was described, but another color conversion processing may be performed. For example, the color may be converted such that the color coordinate values after the conversion are set on a line (e.g. straight line, curve) connecting the color coordinate values (lightness, saturation)=(specific lightness, 0) and the color coordinate values before the conversion. The color may be converted considering the visual characteristics of human eyes. In concrete terms, the color may be converted so that a color closer to the color before conversion is perceived. The color may be converted into a color that is different from a color on the edge of the expanded color gamut. For example, the color may be converted so that the saturation of the output color (color after conversion) gradually lessens from the saturation on the edge, as the saturation of the input color outside the expanded color gamut (color before conversion) drops.

In this example, a case of using the transmission type liquid crystal display apparatus having a backlight unit and a liquid crystal panel was described, but another image display apparatus may be used. For example, a reflection type liquid crystal display apparatus, a micro electro mechanical system (MEMS) shutter type display apparatus, a projector apparatus or the like may be used. In concrete terms, a projector apparatus that includes an optical modulator using a reflecting mirror that can be controlled for each pixel and a light source, such as a mercury lamp and an LED, may be used. In the case of using the projector apparatus, a diaphragm disposed in the optical system for performing projection may be controlled in accordance with the expansion parameter 31. Furthermore, a spontaneous emission type display apparatus, such as an organic EL display apparatus and a plasma display apparatus may be used. In the case of using the spontaneous emission type display apparatus, a duty ratio on the emission time of a display element (e.g. organic EL element, plasma element) may be controlled in accordance with the expansion parameter 31.

Example 2

Example 2 of the present invention will now be described. In Example 1, a case of the image generation apparatus determining the expanded color gamut, performing the color conversion processing including various computations, and performing the brightness conversion processing including various computations, was described. In Example 2, a case of providing conversion information, which is information indicating the correspondence between the pixel values of the input image data and the pixel values of the display image data (output image data) in advance, and generating the display image data from the input image date using this conversion information, will be described. In the following, a processing and configuration that are different from Example 1 will be described in detail, and redundant description on the processing and configuration that are the same as Example 1 will be omitted.

Figure 7:
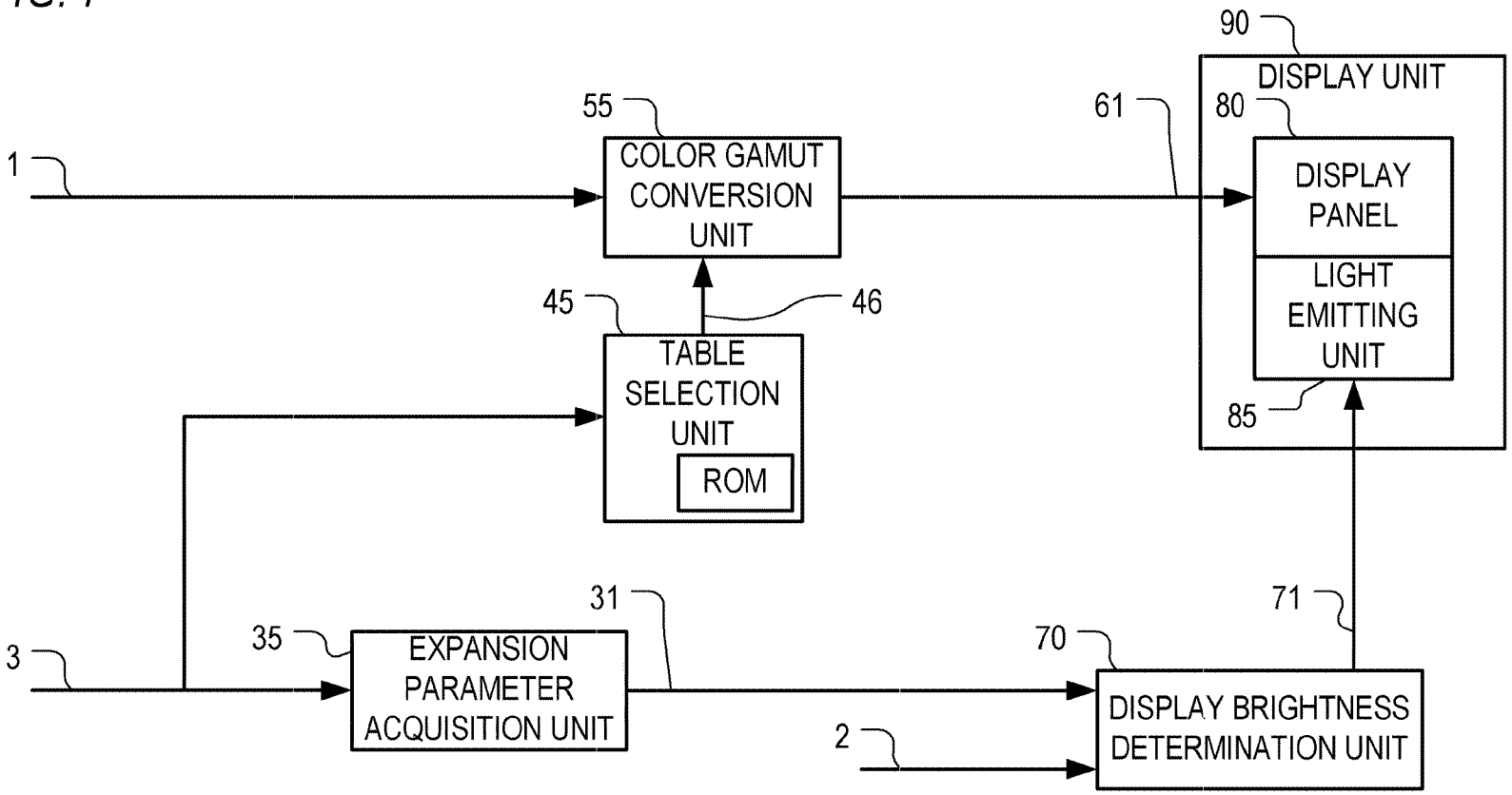
FIG. 7 is a block diagram depicting a configuration example of an image display apparatus according to Example 2.

FIG. 7 is a block diagram depicting a configuration example of the image display apparatus according to this example. An expansion parameter acquisition unit 35 acquires the expansion parameter 31 in accordance with the input color gamut set value 3 from an expansion parameter table which is provided in advance. The expansion parameter table indicates the correspondence between the input color gamut set value and the expansion parameter. FIG. 8 shows an example of the expansion parameter table. The expansion parameter acquisition unit 35 acquires an expansion parameter, which corresponds to the input color gamut set value 3 in the expansion parameter table, as the expansion parameter 31. The correspondence between the input color gamut set value and the expansion parameter is determined in a case where the conversion information is generated in advance.

A table acquisition unit 45 reads a mapping table 46 corresponding to the expansion parameter 31 from a storage unit storing mapping tables (conversion information) which is generated in advance. In concrete terms, an input color gamut set value 3 is input to the table acquisition unit 45, and a mapping table corresponding to the input color gamut set value 3 is read from the storage unit. In FIG. 7, ROM is the storage unit storing the mapping tables, but the storage unit storing the mapping tables is not limited to ROM. The storage unit storing the mapping tables may be a storage unit that is detachable from the image display apparatus. The conversion information is not limited to a table. For example, the conversion information may be a function.

The correspondence between the input color gamut set value and the expansion parameter is not limited to the correspondence shown in the example in FIG. 8. For example, in a case where the input color gamut set value is a set value corresponding to ITU-R_BT.2020, the expansion parameter 1.2 is acquired, and in a case where the input color gamut set value is a set value corresponding to ITU-R_Rec.709 or digital cinema initiatives (DCI), the expansion parameter is not acquired, or the expansion parameter 1 is acquired. For example, the expansion parameter is acquired in a case where the reference color gamut is DCI, and the color gamut of the input image data is a color gamut wider than the reference color gamut DCI (e.g. ITU-R_BT.2020). Further, in a case where the color gamut of the input image data is wider than the reference color gamut DCI, a value that is greater as the color gamut of the input image data is wider, may be acquired as the expansion parameter. For example, in a case where the color gamut of the input image data is the color gamut of an academy color encoding system (ACES), the expansion parameter 1.4 is acquired.

A color gamut conversion unit 55 generates display image data 61 by converting each pixel value of the input image data 1 using a mapping table 46, which is acquired (read) by the table acquisition unit 45.

Figure 9A:
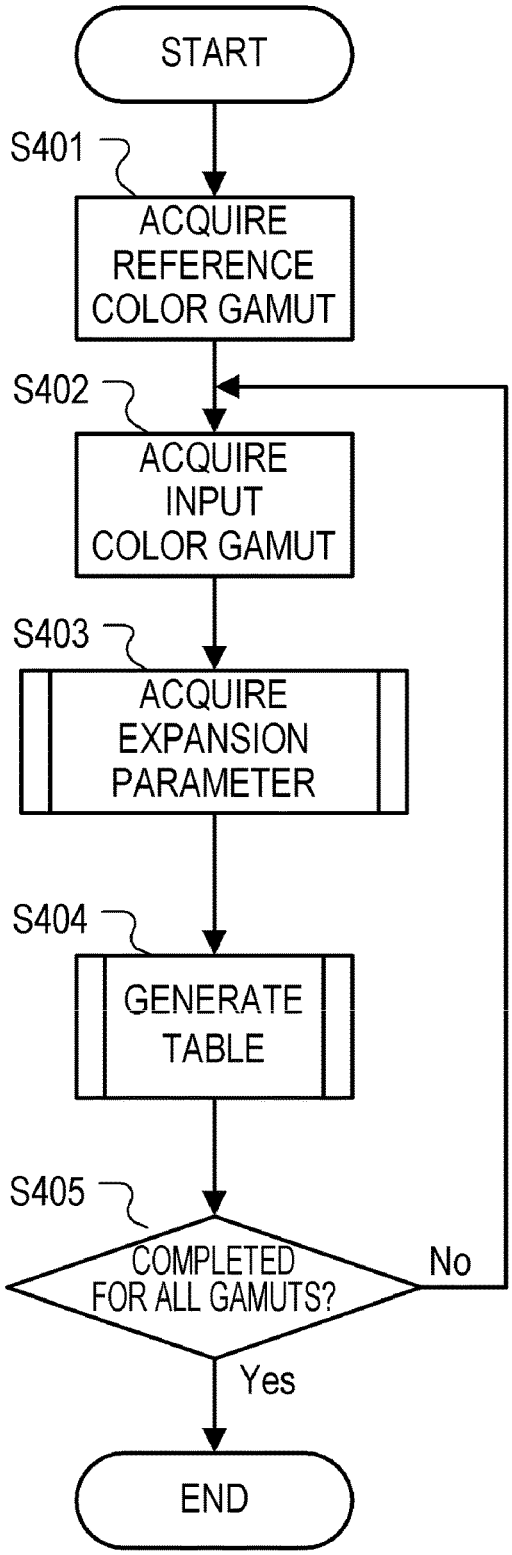
FIG. 9A to FIG. 9C are flow charts respectively depicting an example of the processing flow of the conversion information generation processing according to Example 2.

A concrete example of the conversion information generation processing, which is processing to generate a mapping table (conversion information), will be described next. The mapping table is generated using a computer (e.g. general purpose computer, dedicated computer), which is not illustrated. FIG. 9A is a flow chart depicting an example of the processing flow of the conversion information generation processing.

First, in S401, predetermined information is acquired as the reference color gamut information. Then in S402, the processing target input color gamut set value is acquired. Then in S403, the expansion parameter corresponding to the input color gamut set value acquired in S402 is acquired. Then in S404, based on the input color gamut set value acquired in S402 and the expansion parameter acquired in S403, a mapping table corresponding to the input color gamut set value acquired in S402 is generated. Then in S405, it is determined whether a mapping table is generated for all of the assumed input color gamuts. If there is an input color gamut for which the mapping table is not generated, processing returns to S402. The processing in S402 to S405 are repeated while changing the input color gamut set value until the mapping table is generated for all the input color gamuts. In a case where a respective mapping table is generated for all the input color gamuts, this processing flow ends. The plurality of generated-mapping tables are stored in the storage unit.

Figure 9B:
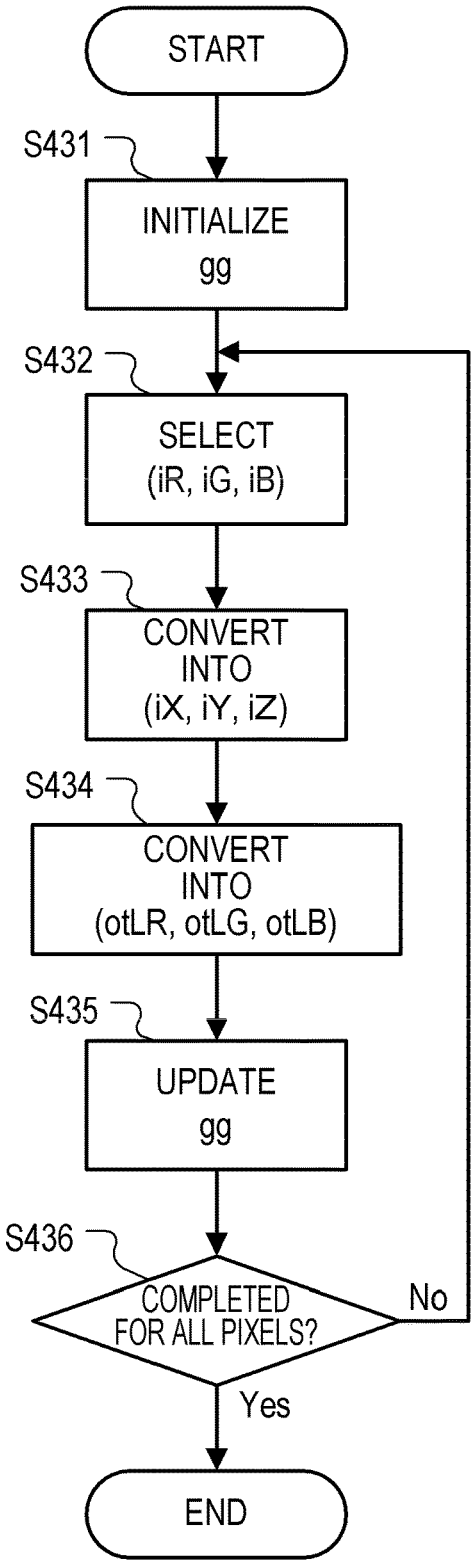

Details on the processing in S403 will be described next, with reference to the flow chart in FIG. 9B. First in S431, 1.0 is set as the initial value of the expansion parameter gg. Then in S432, the possible RGB values (iR, iG, iB) of the input image data 1 are selected. If the input image data 1 is determined in advance, RGB values of the input image data 1 may be selected. Then in S433, the selected RGB values (iR, iG, iB) are converted into the XYZ tristimulus values (iX, iY, iZ). The method for converting the RGB values (iR, iG, iB) into the XYZ tristimulus values (iX, iY, iZ) is the same as the conversion method of the expansion parameter acquisition unit 30 in Example 1. Then in S434, the XYZ tristimulus values (iX, iY, iZ) are converted into the RGB values (otLR, otLG, otLB). The method for converting the XYZ tristimulus values (iX, iY, iZ) into the RGB values (otLR, otLG, otLB) is the same as the conversion method of the expansion parameter acquisition unit 30 in Example 1. As described in Example 1, conversion from the input color gamut into the reference color gamut is performed by this processing.

Then in S435, the expansion parameter gg is updated based on the expansion parameter gg and the RGB values (otLR, otLG, otLB) acquired in S434, as shown in the following Expression 14. gg on the left side of Expression 14 is the updated expansion parameter gg. This means that the expansion parameter gg is updated to the maximum value, out of the expansion parameter gg, the R value otLR, the G value otLG and the B value otLB.

$$gg=\max(gg,otLR,otLG,otLB) \quad \text{(Expression 14)}$$

Then in S436, it is determined whether the processing in S432 to S435 were performed for all the RGB values (iR, iG, iB). If there are RGB values (iR, iG, iB) for which the processing in S432 to S435 were not performed, the processing returns to S432. Then the processing in S432 to S435 are repeated while changing the RGB values (iR, iG, iB), until the processing in S432 to S435 are performed for all the RGB values (iR, iG, iB). In concrete terms, the processing in S432 to S435 are repeated as triple loops, so that the RGB values (iR, iG, iB), of which the range of the R value iR, the range of the G value iG, and the range of the B value iB, are 0 to 255, are sequentially selected. The triple loops are: a loop to sequentially switch the R value iR in the 0 to 255 range; a loop to sequentially switch the G value iG in the 0 to 255 range; and a loop to sequentially switch the B value iB in the 0 to 255 range. In a case where the processing in S432 to S435 are performed for all the RGB values (iR, iG, iB), this processing flow ends.

In this way, according to this example, the color gamut of the input image data is converted into the reference color gamut, and the expansion parameter gg is acquired based on the input image data after the color gamut is converted into the reference color gamut. In concrete terms, the expansion parameter gg is acquired in accordance with the maximum value of the possible gradation values of the input image data after the color gamut is converted into the reference color gamut.

Figure 9C:
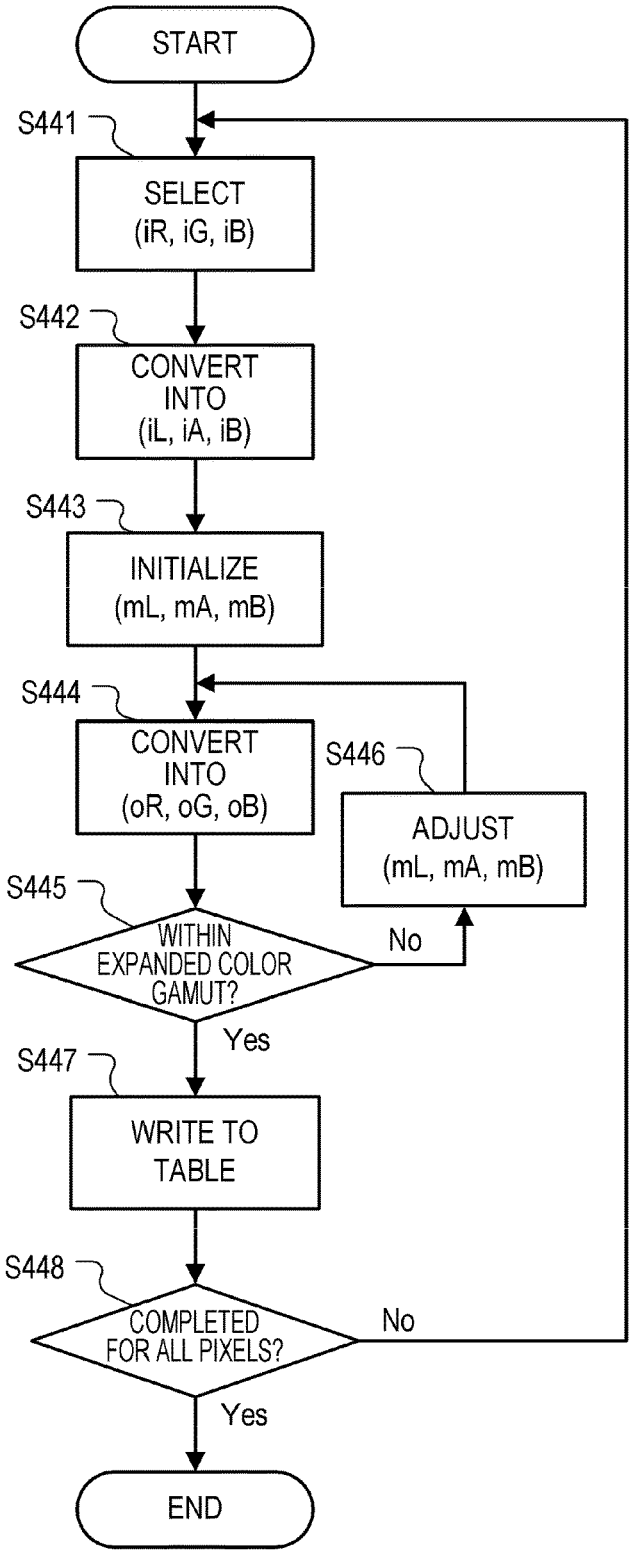

Details on the processing in S404 will be described next with reference to the flow chart in FIG. 9C. First in S441, possible RGB values (iR, iG, iB) of the input image data 1 are selected. If the input image data 1 has been predetermined, the RGB values of the input image data 1 may be selected. The method for converting the RGB values (iR, iG, iB) into the L*a*b* values (iL, iA, iB), that is performed next in S442, is the same as the conversion method used by the color space conversion unit 10 in Example 1. Then in S443, the initial values of the L*a*b* values (mL, mA, mB) are set. The processing in S443 is the same as the processing in S502 in Example 1 (FIG. 4). Then in S444, the L*a*b* values (mL, mA, mB) are converted into the RGB values (oR, oG, oB). The method for converting the L*a*b* values (mL, mA, mB) into the RGB values (oR, oG, oB) is the same as the conversion method used by the color space inverse conversion unit 60 in Example 1.

Then in S445, it is determined whether the color corresponding to the RGB values (oR, oG, oB) is a color within the expanded color gamut. In concrete terms, if at least one of the R value oR, the G value oG and the B value oB is a value outside the range of the possible gradation values (0 to 255) of the display image data 61, it is determined that the color corresponding to the RGB values (oR, oG, oB) is a color outside the expanded color gamut. If all of the R value oR, the G value oG and the B value oB are values in the 0 to 255 range, then it is determined that the color corresponding to the RGB values (oR, oG, oB) is a color within the expanded color gamut. If it is determined that the color corresponding to the RGB values (oR, oG, oB) is a color outside the expanded color gamut, processing advances to S446, and if it is determined that the color corresponding to the RGB values (oR, oG, oB) is a color within the expanded color gamut, processing advances to S447.

In S446, the L*a*b* values (mL, mA, mB) are adjusted. In concrete terms, the L*a*b* values (mL, mA, mB) after the adjustment are calculated using the following Expressions 15-1 to 15-3. The values on the left side of Expressions 15-1 to 15-3 are values after the adjustment. Processing then returns to S444. The processing in S444 to S446 are repeated until it is determined that the color corresponding to the RGB values (oR, oG, oB) is a color within the expanded color gamut. If the color corresponding to the RGB values (oR, oG, oB) is a color within the expanded color gamut, processing advances to S447.

$$mL=mL+(100-iL)\times 0.01 \quad \text{(Expression 15-1)}$$

$$mA=mA-iA\times 0.01 \quad \text{(Expression 15-2)}$$

$$mB=mB-iB)\times 0.01 \quad \text{(Expression 15-3)}$$

In S447, the RGB values (oR, oG, oB) are written in a mapping table as the RGB values of the display image data corresponding to the RGB values (iR, iG, iB) of the input image data. Then in S448, it is determined whether the processing in S441 to S447 were performed for all the RGB values (iR, iG, iB). If there is any of the RGB value (iR, iG, iB) for which the processing in S441 to S447 were not performed, processing returns to S441. The processing in S441 to S447 are repeated while changing the RGB values (iR, iG, iB) until the processing in S441 to S447 are performed for all the RGB values (iR, iG, iB). In a case where the processing in S441 to S447 are performed for all the RGB values (iR, iG, iB), this processing flow ends.

Figure 10:
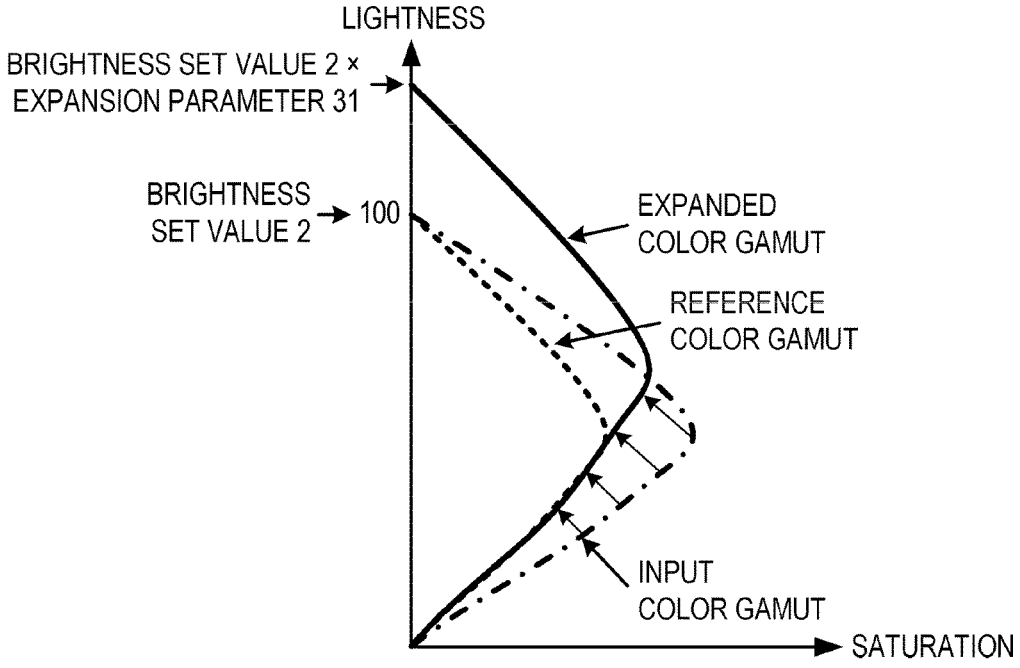
FIG. 10 is a diagram depicting an example of the color conversion processing according to Example 2.

According to this method (Expressions 15-1 to 15-3), a color outside the expanded color gamut is converted into a color within the expanded color gamut by compressing the saturation while maintaining the perceived lightness, as shown in FIG. 10. For a color before the conversion, which is a color within the expanded color gamut, only the brightness conversion processing based on the expansion parameter gg is performed.

As described above, according to this example, the conversion information is generated in advance. Then using the conversion information generated in advance, the input image data is converted into the display image data. Thereby the processing load of the image display apparatus and the image generation apparatus can be reduced.

Example 3

Example 3 of the present invention will be described next. In Example 1, a case of using an expansion parameter for uniformly increasing the display brightness of each color of the image display apparatus was described. In Example 3, a case of using a plurality of expansion parameters corresponding to a plurality of color components respectively will be described. For example, in this example, a light emitting unit has a plurality of light sources of which emission colors are different from one another, and a parameter to increase the emission brightness of the light source from the reference brightness is used for each of the plurality of light sources. The plurality of color components are not especially limited, but in this example, a case of using an expansion parameter to increase the display brightness of red, an expansion parameter to increase the display brightness of green, and an expansion parameter to increase the display brightness of blue, as the plurality of expansion parameters, will be described. In the following, a processing and configuration that are different from Example 1 will be described in detail, and redundant description on a processing and configuration the same as Example 1 will be omitted.

The configuration of the image display apparatus according to Example 3 is the same as Example 1. An expansion parameter acquisition unit 30 has the same function as Example 1. In Example 3, however, the expansion parameter acquisition unit 30 acquires the above mentioned three expansion parameters: ggR, ggG and ggB.

First the expansion parameter acquisition unit 30 acquires the maximum gradation value otLmaxA for each of red, green and blue. In concrete terms, the expansion parameter acquisition unit 30 determines the maximum value of each R value otLR as the maximum gradation value otLmaxAR of red. In the same manner, the expansion parameter acquisition unit 30 determines the maximum value of each G value otLG as the maximum gradation value otLmaxAG of green, and determines the maximum value of each B value otLB as the maximum gradation value otLmaxAB of blue. In other words, the expansion parameter acquisition unit 30 determines the maximum gradation value otLmaxAR, otLmaxAG and otLmaxAB using the following Expressions 16-1 to 16-3, $$otL\max AR = \max(otLR \text{ of each pixel}) \quad \text{(Expression 16-1)}$$

$$otL\max AG = \max(otLG \text{ of each pixel}) \quad \text{(Expression 16-2)}$$

$$otL\max AB = \max(otLB \text{ of each pixel}) \quad \text{(Expression 16-3)}$$

Then expansion parameter acquisition unit 30 determines the expansion parameters ggR, ggG and ggB using the following Expressions 17-1 to 17-6. In other words, if the maximum gradation value otLmaxAR is greater than 1, the expansion parameter acquisition unit 30 determines the maximum gradation value otLmaxAR as the expansion parameter ggR, as shown in Expression 17-1. If the maximum gradation value otLmaxAR is 1 or less, the expansion parameter acquisition unit 30 determines 1 as the expansion parameter ggR, as shown in Expression 17-2. In the same manner, the expansion parameters ggG and ggB are determined using Expressions 17-3 to 17-6.

$$\text{If } otL\max AR > 1 : ggR = otL\max AR \quad \text{(Expression 17-1)}$$

$$\text{If } otL\max AR \leq 1 : ggR = 1 \quad \text{(Expression 17-2)}$$

$$\text{If } otL\max AG > 1 : ggG = otL\max AG \quad \text{(Expression 17-3)}$$

$$\text{If } otL\max AG \leq 1 : ggG = 1 \quad \text{(Expression 17-4)}$$

$$\text{If } otL\max AB > 1 : ggB = otL\max AB \quad \text{(Expression 17-5)}$$

$$\text{If } otL\max AB \leq 1 : ggB = 1 \quad \text{(Expression 17-6)}$$

An expanded color gamut determination unit 40 has a function the same as Example 1. In Example 3, however, the method for determining the color gamut flag N is different from Example 1. In Example 3, in a case where any one of the following Conditions 1 to 3 is established, the expanded color gamut determination unit 40 determines that the target color is a color outside the expanded color gamut, and sets the color gamut flag N=0 corresponding to the target color. In a case where none of the following conditions 1 to 3 are established, the expanded color gamut determination unit 40 determines that the target color is a color within the expanded color gamut, and sets the color gamut flag N=1 corresponding to the target color.

Condition 1: tLR>ggR
Condition 2: tLG>ggG
Condition 3: tLB>ggB

A color space inverse conversion unit 60 has a function the same as Example 1. However, the method for converting the RGB values (mLR, mLG, mLB) into the RGB values (oLR, oLG, oLB), in other words, the brightness conversion processing method, is different from Example 1. In Example 3, the color space inverse conversion unit 60 performs the brightness conversion processing for red, green and blue independently. In concrete terms, the color space inverse conversion unit 60 calculates the RGB values (oLR, oLG, oLB) from the RGB values (mLR, mLG, mLB) using the following Expressions 18-1 to 18-3.

$$oLR = mLR/ggR \quad \text{(Expression 18-1)}$$

$$oLG = mLG/ggG \quad \text{(Expression 18-2)}$$

$$oLB = mLB/ggB \quad \text{(Expression 18-3)}$$

A display brightness determination unit 70 has a function the same as Example 1. However, in Example 3, the color space inverse conversion unit 60 acquires, as the display brightness value 71, a value LdrvR on the maximum display brightness of red, a value LdrvG on the maximum display brightness of green, and a value LdrvB on the maximum display brightness of blue. In concrete terms, the color space inverse conversion unit 60 calculates the display brightness values LdrvR, LdrvG and LdrvB using the following Expressions 19-1 to 19-3.

$$LdrvR = Lset \times ggR \quad \text{(Expression 19-1)}$$

$$LdrvG = Lset \times ggG \quad \text{(Expression 19-2)}$$

$$LdrvB = Lset \times ggB \quad \text{(Expression 19-3)}$$

As described above, according to this example, a processing the same as Example 1 is performed for each of a plurality of color components. Thereby, compared with Example 1, gradations of colors and lightness can be displayed more naturally.

Examples 1 to 3 are merely examples, and a configuration acquired by appropriately modifying or changing the configurations of Example 1 to 3 within the scope of the spirit of this invention is also included in the present invention. A configuration acquired by appropriately combining the configurations of Examples 1 to 3 is also included in the present invention.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to readout and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-244209, filed on Dec. 15, 2015, and Japanese Patent Application No. 2016-198718, filed on Oct. 7, 2016, which are hereby incorporated by reference herein in their entirety.

What is claimed is:

1. An image display apparatus, comprising:

a display panel configured to display an image;

a backlight configured to emit light onto the display panel; and at least one processor that operates as:

an acquisition unit configured to acquire an expansion parameter to expand a reproducible color gamut, which is a range of colors that the image display apparatus can reproduce, from a reference color gamut to an expanded color gamut;

a determination unit configured to acquire a plurality of pixel values corresponding to a plurality of color components of input image data, and to determine whether or not each of the plurality of color components is a color within the expanded color gamut, based on each of the acquired plurality of pixel values and the expansion parameter; and a conversion unit configured to generate output image data by performing, on input image data, color conversion processing to convert a color outside the expanded color gamut into a color within the expanded color gamut based on the determination result by the determination unit, wherein the backlight increases an emission brightness of the backlight based on the expansion parameter.

2. The image display apparatus according to claim 1, wherein the acquisition unit acquires the expansion parameter based on the input image data.

3. The image display apparatus according to claim 1, wherein the acquisition unit acquires the expansion parameter in a case where a predetermined operation mode is selected by the user.

4. The image display apparatus according to claim 1, wherein the conversion unit generates the output image data by performing, on the input image data, the color conversion processing and brightness conversion processing to reduce, based on the expansion parameter, an increase in a display brightness of the image display apparatus caused by the expansion parameter.

5. The image display apparatus according to claim 1, wherein the backlight includes a plurality of white light sources.

6. An image display apparatus, comprising:

a display panel configured to display an image;

a backlight configured to emit light onto the display panel; and at least one processor that operates as:

an acquisition unit configured to acquire an expansion parameter to expand a reproducible color gamut, which is a range of colors that the image display apparatus can reproduce, from a reference color gamut to an expanded color gamut; and a conversion unit configured to generate output image data by performing, on input image data, color conversion processing to convert a color outside the expanded color gamut into a color within the expanded color gamut based on the expansion parameter, wherein the acquisition unit acquires a plurality of expansion parameters corresponding to a plurality of color components of the input image data respectively, the conversion unit performs the color conversion processing on the input image data based on the plurality of expansion parameters, and the backlight increases an emission brightness of the backlight based on the plurality of expansion parameters.

7. An image display apparatus, comprising:

a display panel configured to display an image;

a backlight configured to emit light onto the display panel; and at least one processor that operates as:

an acquisition unit configured to acquire an expansion parameter to expand a reproducible color gamut, which is a range of colors that the image display apparatus can reproduce, from a reference color gamut to an expanded color gamut; and a conversion unit configured to generate output image data by performing, on input image data, color conversion processing to convert a color outside the expanded color gamut into a color within the expanded color gamut based on the expansion parameter, wherein the acquisition unit converts the color gamut of the input image data into the reference color gamut, and acquires the expansion parameter based on the input image data after the color gamut is converted into the reference color gamut, and the backlight increases an emission brightness of the backlight based on the expansion parameter.

8. The image display apparatus according to claim 7, wherein the acquisition unit acquires the expansion parameter in accordance with the maximum value of gradation values of the input image data after the color gamut is converted into the reference color gamut.

9. The image display apparatus according to claim 7, wherein the acquisition unit acquires the expansion parameter in accordance with the maximum value of possible gradation values of the input image data after the color gamut is converted into the reference color gamut.

10. An image display apparatus, comprising:

a display panel configured to display an image;

a backlight configured to emit light onto the display panel; and at least one processor that operates as:

an acquisition unit configured to acquire an expansion parameter to expand a reproducible color gamut, which is a range of colors that the image display apparatus can reproduce, from a reference color gamut to an expanded color gamut; and a conversion unit configured to generate output image data by performing, on input image data, color conversion processing to convert a color outside the expanded color gamut into a color within the expanded color gamut based on the expansion parameter, wherein the acquisition unit acquires the expansion parameter based on the input image data in a case where the color gamut of the input image data is wider than the reference color gamut, and the backlight increases an emission brightness of the backlight based on the expansion parameter.

11. An image display apparatus, comprising:

a display unit configured to display an image; and at least one processor that operates as:

an acquisition unit configured to acquire an expansion parameter to expand a reproducible color gamut, which is a range of colors that the image display apparatus can reproduce, from a reference color gamut to an expanded color gamut;

a determination unit configured to acquire a plurality of pixel values corresponding to a plurality of color components of input image data, and to determine whether or not each of the plurality of color components is a color within the expanded color gamut, based on each of the acquired plurality of pixel values and the expansion parameter; and a conversion unit configured to generate output image data by performing, on input image data, color conversion processing to convert a color outside the expanded color gamut into a color within the expanded color gamut based on the determination result by the determination unit, wherein the display unit increases a display brightness of the display unit based on the expansion parameter.

12. A conversion information generation method, comprising:

an acquisition step of acquiring an expansion parameter to expand a reproducible color gamut, which is a range of colors that an image display apparatus can reproduce, from a reference color gamut to an expanded color gamut by increasing a display brightness of the image display apparatus;

a determination step of acquiring a plurality of pixel values corresponding to a plurality of color components of input image data, and determining whether or not each of the plurality of color components is a color within the expanded color gamut, based on each of the acquired plurality of pixel values and the expansion parameter; and a conversion step of generating, by performing color conversion processing to convert a color outside the expanded color gamut into a color within the expanded color gamut, on a plurality of possible pixel values of the input image data, based on the determination result in the determination step, information indicating correspondence between pixel values of the input image data and pixel values after the color conversion processing is performed, as conversion information.

* * * * *